US005315749A

United States Patent [19]

Nenadic et al.

[11] Patent Number: 5,315,749

[45] Date of Patent: May 31, 1994

[54] METHOD FOR HOLDING SUBSTRATES

[75] Inventors: Anton Nenadic, Red Hook; Kenneth Furman, Hyde Park; Robert W. Pasco, Wappingers Falls, all of N.Y.

[73] Assignee: International Business Machines Corporation, Armonk, N.Y.

[21] Appl. No.: 951,919

[22] Filed: Sep. 28, 1992

Related U.S. Application Data

[62] Division of Ser. No. 897,182, Jun. 10, 1992, Pat. No. 5,226,636.

[51] Int. Cl.[5] ..... B25B 11/00

[52] U.S. Cl. ..... 29/559; 269/21; 269/75; 269/309

[58] Field of Search ..... 269/20, 21, 71, 75, 269/76, 309, 296, 900, 297-301; 33/573, 570, 568; 279/3; 294/64.1; 51/235; 29/559

[56] References Cited

U.S. PATENT DOCUMENTS

| | | | |
|---|---|---|---|
| 3,188,078 | 6/1965 | Peterson | 33/570 |
| 4,357,006 | 11/1982 | Hayes | 269/296 |
| 4,390,172 | 6/1983 | Gotman | 269/309 |
| 4,461,463 | 7/1984 | Okubo | 269/75 |
| 4,509,265 | 4/1985 | Donaldson | 33/573 |
| 4,545,570 | 10/1985 | KaDell | 269/296 |
| 5,026,033 | 6/1991 | Roxy | 269/309 |
| 5,107,599 | 4/1992 | Marincic et al. | 269/309 |
| 5,115,549 | 5/1992 | Maruyama | 269/309 |

*Primary Examiner*—Robert C. Watson
*Attorney, Agent, or Firm*—Whitham & Marhoefer

[57] ABSTRACT

A method of holding utilizing a fixture with five discrete vacuum elements provides support at four peripheral points on a substrate and at the substrate center. Two peripheral vacuum elements are fixed in position on a rigid frame. The remaining peripheral elements and the center element are fixed to a gimbal disc. This gimbal disc is mounted on the frame in such a way that it has three degrees of rotational movement relative to the frame. Downward pressure of a substrate resting on the two fixed elements, brings all three gimbal disc mounted supports into contact with the substrate, without allowing or causing deflection of the substrate. The mounting is locked, and vacuum is applied to all the elements to secure the substrate in place for the planarizing operation.

3 Claims, 4 Drawing Sheets

METHOD FOR HOLDING SUBSTRATES

This application is a divisional of co-pending application Ser. No. 07/897,182, filed on Jun. 10, 1992, now U.S. Pat. No. 5,225,636.

BACKGROUND OF THE INVENTION

1. Field of the Invention

This invention relates to an improved fixture for holding substrates, especially during precision planarization of the substrate surface, and more particularly to an improved holding fixture for holding flexible substrates.

2. Description of the Prior Art

Precision planarization of thin, flexible substrates, such as glass ceramic substrates and semiconductor wafers commonly used in the semiconductor industry, is extremely difficult. Such substrates readily flex when loaded in a holding fixture and relax when unloaded after the planarization process, causing a out-of-flat condition in the planarized surface. The problem is compounded by the fact that the substrate surfaces may not be parallel, or flat, and that there may be imperfections in either or both surfaces. Similar problems occur during detailed machining to a precisely controlled depth, photo lithography exposure and similar applications.

There have been a number of proposals in the prior art with respect to various designs for vacuum chucks. But none of these proposals is altogether satisfactory for precisely holding flexible substrates during a precision planarization of one of its surfaces. Following are some of the proposals:

U.S. Pat. No. 4,088,312 to Froeck et al., discloses a variable contour securing system. The retaining mechanism includes a spaced array of adjustable spindles mounted on a housing. Each spindle has a base member support cup at one end thereof. A vacuum source is applied t the cups for seating the member adjacent to the cups.

U.S. Pat. No. 4,684,113 to Douglas et al., discloses a universal holding fixture for holding a work piece having a contoured holding surface. The fixture includes a plurality of work piece engaging rods which are individually adjustable in height to thereby reproduce the contour of the contoured holding surface.

U.S. Pat. No. 4,656,791 to Herrington et al., discloses a support apparatus for supporting a workpiece in a high velocity fluid jet cutting operation. The support apparatus comprises a pair of independent support members that cooperate to provide uniform support to the entire area of the sheet during cutting.

Russian Patent No. SU-761-411, discloses a vacuum operated lifting grab device which has a tube locator with split conical bush, threaded sections with nuts and vacuum collector chambers connected to rigid rods.

SUMMARY OF THE INVENTION

One purpose of this invention is the provision of a holding fixture that can securely support a flexible substrate to enable planarization of its surface to submicron tolerances. A holding fixture that supports and holds the substrate without flexing it. A holding fixture that allows sub-micron control of surface flatness independently of the substrate surface flatness, parallelism, or surface perfection.

Briefly, this invention contemplates the provision of holding fixture with five discrete vacuum elements provides support at four peripheral points on a substrate and at the substrate center. Two peripheral vacuum elements are fixed in position on a rigid frame. The remaining peripheral elements and the center element are fixed to a gimbal disc. This gimbal disc is mounted on the frame in such a way that it has three degrees of rotational movement relative to the frame. Downward pressure of a substrate resting on the two fixed elements, brings all three gimbal disc mounted supports into contact with the substrate, without allowing or causing deflection of the substrate. The mounting is locked, and vacuum is applied to all the elements to secure the substrate in place for the planarizing operation.

No adjustment of support members is necessary. The supports members are fully self aligning, therefore loading and unloading of substrate is fast. The fixture is for that reason very suitable for manufacturing processes and high throughput.

The principal operation of a holding fixture in accordance with the teachings of this invention is an extension of the principle that 3 points establish a plane. It is well known in the art to use a 3-point-system to support a relatively flat workpiece without influencing the contour of the workpiece. This provides stabile, non-rocking support. However, only fairly rigid work pieces can be held in this manner since the areas left unsupported must be sufficiently strong to resist whatever working forces are applied and might cause deformation of the workpiece. This invention provides additional and more uniform support while adhering to the 3-point principle.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
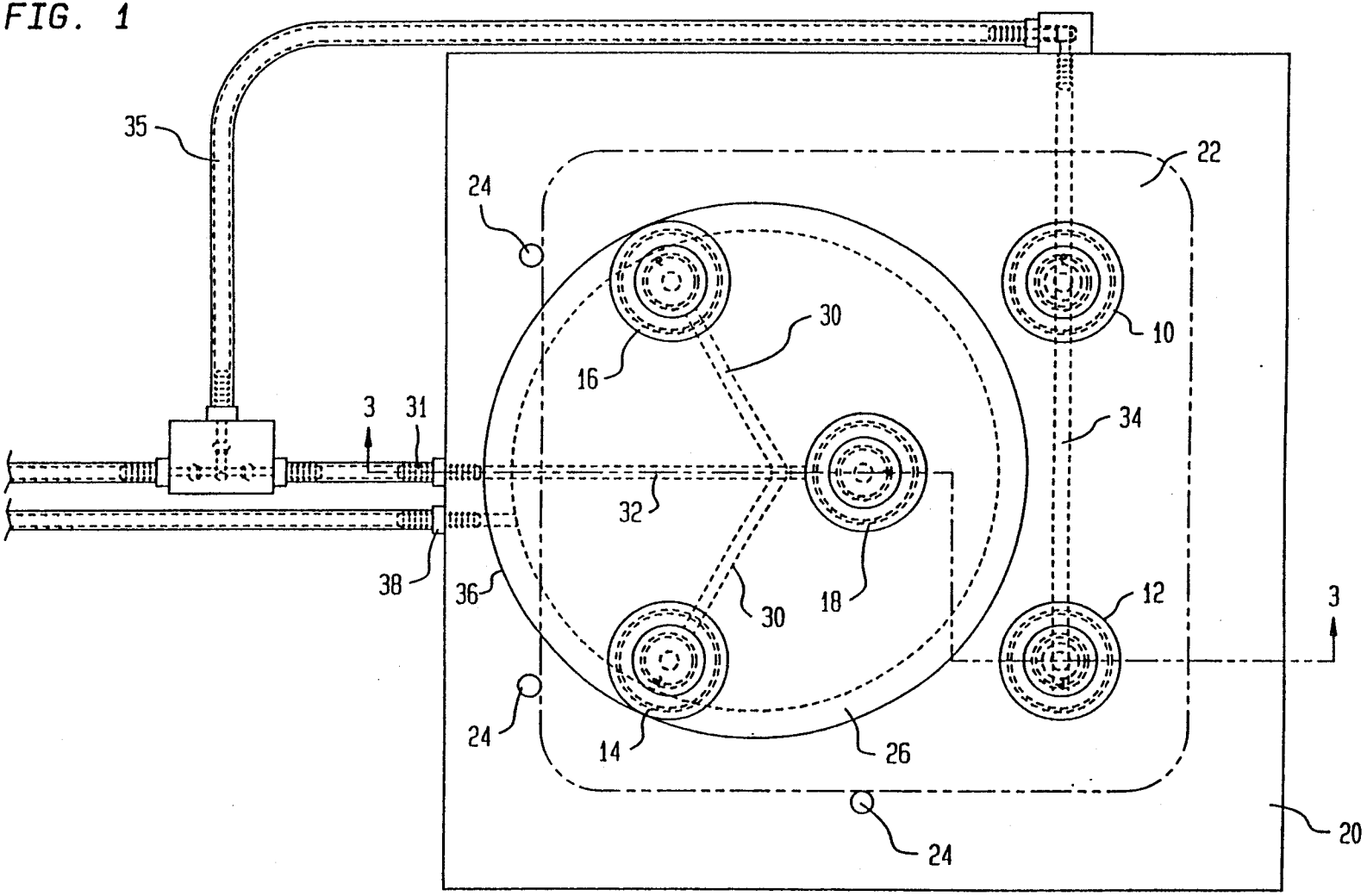
FIG. 1 is a top plan view of one embodiment of a holding fixture in accordance with the teachings of this invention.

Referring now to FIG. 1 of the drawings, five discrete vacuum elements labeled 10, 12, 14, 16 and 18 are mounted on a base plate in form of a rigid frame 20. The discrete vacuum elements are arranged so that hey provide support for the four corner regions and the center region of a substrate 22 (shown in phantom), such as, for example, a glass ceramic or semiconductor substrate. Pins 24 secured to the frame 20 locate the substrate 22 with respect to the vacuum elements.

Two of the vacuum elements, elements 10 and 12, are rigidly secured to the stage 20, and the remaining three elements, 14, 16 and 18 are secured to gimbal disc 26 that allows three degrees of rotational movement of the elements 14, 16 and 18 relative to the frame 20, will be explained in more detail in connection with FIG. 3. Passageways 30, located within the gimbal disc couple external vacuum source hose fitting 31 via a flexible hose 32 to the vacuum elements 14, 16 and 18. Passageways 34 within the frame 20 couple external vacuum source hose 35 to the vacuum elements 10 and 12. A passageway 36 couples the gimbal disc 26 to a suitable source of pressurized air via external hose fitting 38.

Figure 2B:
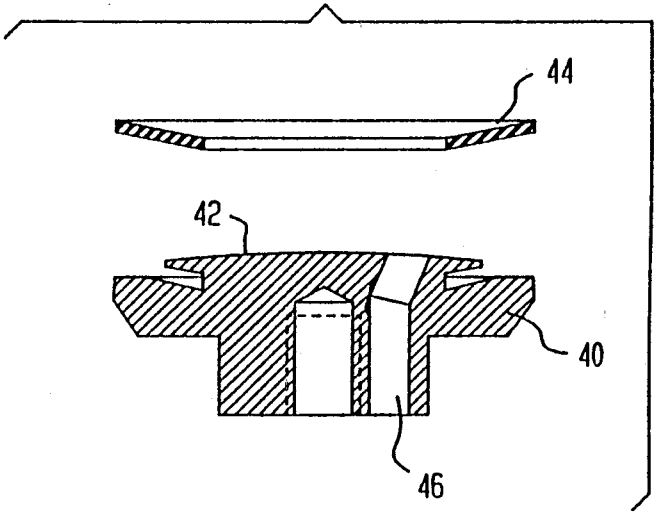
FIGS. 2A and 2B respectively a detail plan view of vacuum element, and a sectional view along the line 2B—2B of the vacuum element.
Figure 2A:
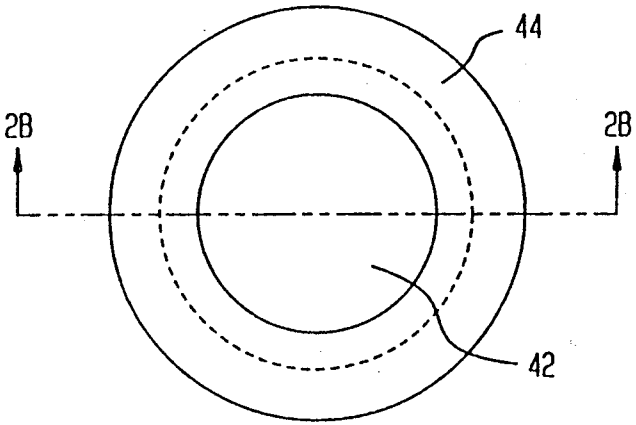

Referring now to FIG. 2A and 2B, each vacuum element is preferably substantially identical in construction. Each comprises a rigid support member 40 with a bearing surface 42 that provides point contact with the lower surface of a substrate mounted on the holding fixture. Such bearing surface has a radius of curvature, such as a spherical surface or a parabolic surface, to name a few. The support member 40 is secured to the frame 20 in the case of elements 10 and 12, and to the gimbal disc 26 in the case of elements 14, 16 and 18. A seal 44, such as a sealing washer or an O-ring or a sealing bellow is attached to the bearing or support member 40. When vacuum is applied through passages 46 in the support member 40 the substrate 22 is secured to the support or bearing member 40.

Figure 3:
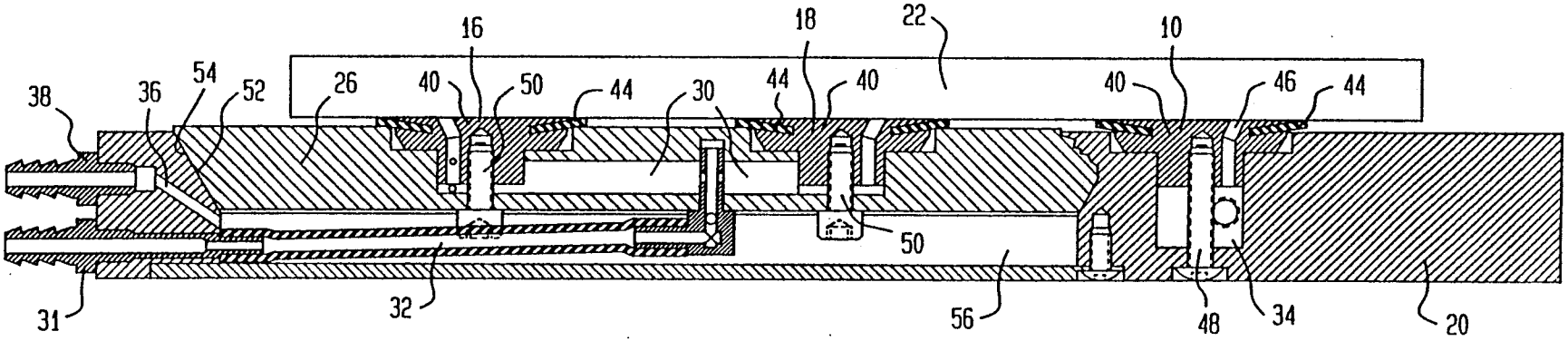
FIG. 3 is a side elevation, with parts shown in section (along line III—III of FIG. 1), of the holding fixture shown in FIG. 1.

Referring now to FIG. 3, a screw 48 that passes through passageway 34 secures support member 40 to the frame 20 in the case of elements 10 and 12. Screws 50 secure support members 40 to the gimbal disc 26 in the case of elements 14, 16 and 18.

The gimbal disc 26 has a spherical surface 52 that closely fits with a matching spherical surface 54 in the frame 20 preferably allowing three degrees of rotational motion of the elements 14, 16 and 18 relative to the frame 20, but virtually no translational motion relative to the fixed elements 10 and 12, although only two degrees of rotational freedom are required to obtain the desired adjustability. The required two axes of rotation are orthogonal to one another and lie in the plane of the gimbal disc 26. The third axis, provided in this preferred embodiment, is vertical to the gimbal disc 26. Air under pressure from external fitting 38 is conducted via passageway to a chamber 56. When the chamber 56 is pressurized, the gimbal disc 26 floats on a thin layer air passing between the matching spherical surfaces 52 and 54. This allows the gimbal disc to move freely in response to any slight unbalance force exerted by substrate on the elements 14, 16 or 18. When all five point contact vacuum elements are in contact with a substrate surface, a partial vacuum can be drawn in the chamber 56 to lock the gimbal disc 26 to the frame.

A flexible hose 32 in the chamber 56 couples the external vacuum fitting 31 to passageways 30 in the gimbal disc 26 which in turn connect to passages 46 in the support members. This creates a low pressure within the seals 44 in order to secure the substrate 22 to the support members 40.

In total, five support points contact the workpiece or the substrate. Three of these supports are rigidly attached to the top surface of a gimbal disc and equally spaced, as in the corners of a triangle. The outer periphery of the disc is sperically shaped and forms a half of a gimbal set. The remaining two supports are fixed and rigidly attached towards one edge of the top surface of a larger frame so as to form two of the corners of a triangle. The frame or base plate also has a sperical seat formed in its top surface which creates the other half of the gimbal set to mate with the disc described above. This seat is located central to and towards the edge opposite the fixed support members. The supports on the gimballed disc are oriented to the base plate or frame in such a way that two of the support members re towards the edge of the frame top surface opposite the two fixed supports in the frame. These four support members would form the corners of a square. The third support member on the gimballed disc will be located centrally among the other four supports.

The gimballed disc is free to float on its spherical face within the sperical seat of the base plate or frame. This allows the three support members on the gimbals disc 26 to conform to the orientation of any plane presented to them. The three support members on the gimbal disc establish the three points of a first plane free to float within the confines of the gimbal geometry. The center point of the gimbal is utilized along with the two support members attached to the frame to establish the three points of a second plane. The gimbal disc is then locked in its seat with vacuum. The work piece or substrate is now supported in a compliant manner by five points.

In operation a flexible substrate with a flat lower surface is placed in the proximity of the five support members arranged in the manner as described above. The plane of the triangle of the three support members connected to the gimbal disc, (i.e. the three support members forming a rigid triangle) is adjusted until all five support members make contact with the substrate surface. The support members forming the triangle are then locked in order to prohibit further movement of the plane with regard to the frame.

Figure 4:
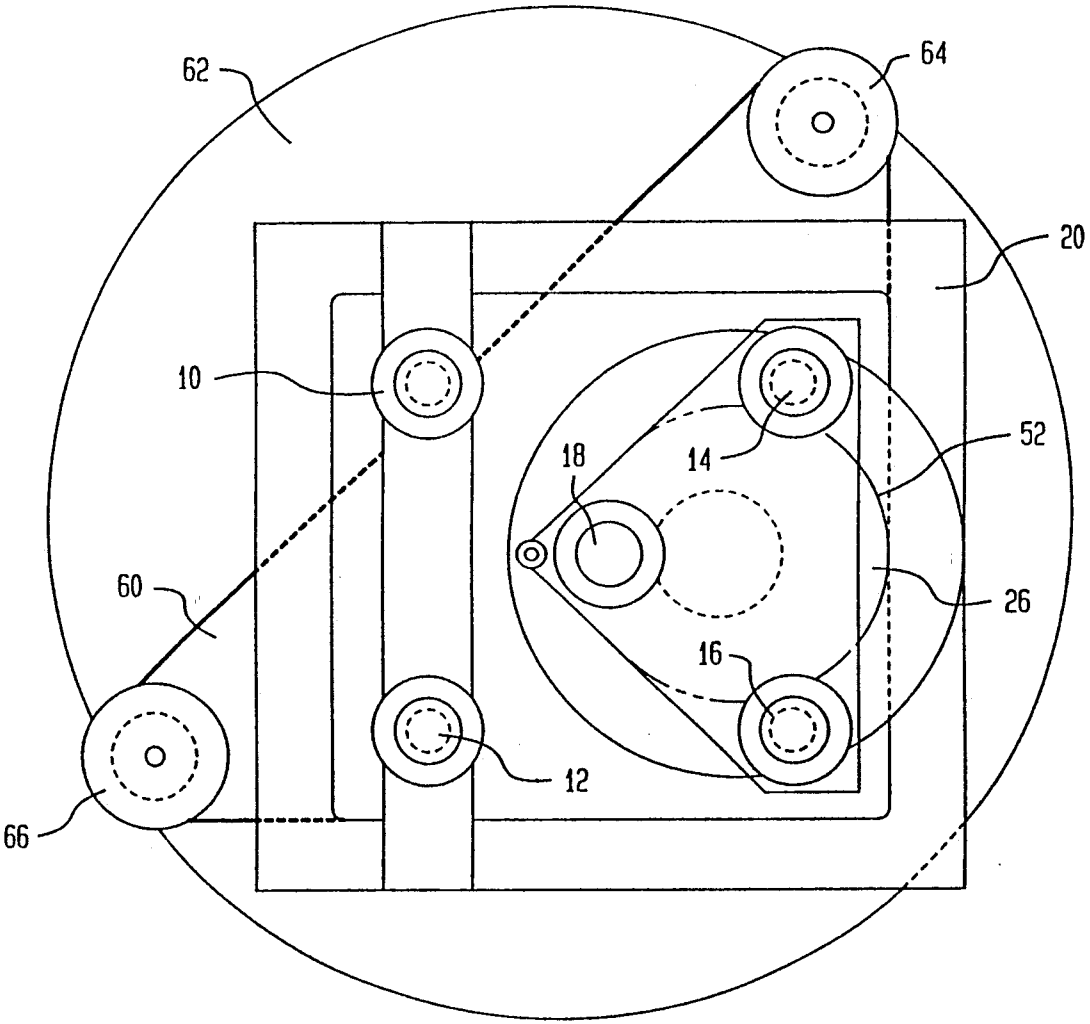
FIG. 4 is a top plan view of a holding fixture in accordance with the teaching of this invention, showing the mounting with leveling screws of the frame as a stage.

Referring now to FIG. 4 of the drawings, a holding fixture similar to the embodiment shown in FIGS. 1 and 3 is mounted with frame 20 on a stage 60. Stage 60 has a triangular shape and is supported at three points, standing on a base plate 62. At two points, leveling screws 64 and 66 allow alignment of the plane of the top surface of the substrate (not shown) with respect to the planarization tool.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A method for holding and supporting a flexible substrate with a flat lower surface, comprising the steps of:

placing the substrate in the proximity of an arrangement of five support members, two of said support members being attache to a frame and the other three of said support members forming a rigid triangle, the plane of said triangle being movable with respect to said frame; and adjusting said plane of said triangle until all five of said support members are in contact with said lower surface of the substrate.

2. The method of claim 1, further comprising the step of locking said support members forming a triangle to prohibit further movement of said plane of said triangle with regard to said frame.

3. A method for holding and supporting a flexible substrate with a flat lower surface as in claim 1, comprising the further step of securing said substrate to said five support members by means of a vacuum applies to each of said support members at a point where each of said support members contacts said substrate.

* * * * *